US012768025B2

(12) United States Patent
Ito et al.

(10) Patent No.: US 12,768,025 B2
(45) Date of Patent: Oct. 20, 2026

(54) GAS WIPING NOZZLE AND METHODS FOR MANUFACTURING HOT-DIP METAL-COATED STEEL STRIP AND GAS WIPING NOZZLE

(71) Applicant: JFE STEEL CORPORATION, Tokyo (JP)

(72) Inventors: Yu Ito, Tokyo (JP); Hideyuki Takahashi, Tokyo (JP); Kenji Yamashiro, Tokyo (JP); Takumi Koyama, Tokyo (JP); Yoshihiko Kaku, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 100 days.

(21) Appl. No.: 18/716,260

(22) PCT Filed: Oct. 11, 2022

(86) PCT No.: PCT/JP2022/037767
§ 371 (c)(1),
(2) Date: Jun. 4, 2024

(87) PCT Pub. No.: WO2023/105910
PCT Pub. Date: Jun. 15, 2023

(65) Prior Publication Data

US 2025/0034691 A1 Jan. 30, 2025

(30) Foreign Application Priority Data

Dec. 10, 2021 (JP) ..... 2021-200565

(51) Int. Cl.
*C23C 2/20* (2006.01)
*C23C 2/06* (2006.01)
*C23C 2/40* (2006.01)

(52) U.S. Cl.
CPC ..... *C23C 2/20* (2013.01); *C23C 2/06* (2013.01); *C23C 2/40* (2013.01)

(58) Field of Classification Search
CPC .... C23C 2/20; C23C 2/06; C23C 2/40; C23C 2/00; C23C 2/003; B05B 1/005;
(Continued)

(56) References Cited

FOREIGN PATENT DOCUMENTS

CN 107108931 A 8/2017
EP 3214117 A1 9/2017
(Continued)

OTHER PUBLICATIONS

JP-2008190001-A English translation. (Year: 2008).*
(Continued)

*Primary Examiner* — Hai Y Zhang
(74) *Attorney, Agent, or Firm* — Oliff PLC

(57) ABSTRACT

A gas wiping nozzle and a method for manufacturing a hot-dip metal-coated steel strip using the gas wiping nozzle. The gas wiping nozzle adjusts the coating weight of a molten metal on the surface of a steel strip pulled up from a molten metal bath. At least the surface of the gas wiping nozzle is made of a ceramic, and the arithmetic mean roughness Ra and the peak count PPI of the gas wiping nozzle satisfy Formula (1):

$$PPI > c1 \times Ra + c2 \quad (1)$$

PPI: peak count (the number of peaks per inch)
Ra: arithmetic mean roughness [μm]
c1 and c2: determined constants for each ceramic used in the surface of the gas wiping nozzle.

6 Claims, 3 Drawing Sheets

(58) Field of Classification Search
CPC ..... B05B 1/044; B05B 15/50; B05B 1/04; B05C 11/06
See application file for complete search history.

(56) References Cited

FOREIGN PATENT DOCUMENTS

| | | | | |
|---|---|---|---|---|
| JP | H06-17560 | B2 | | 3/1994 |
| JP | H06-134925 | A | | 5/1994 |
| JP | H08-27555 | A | | 1/1996 |
| JP | H08-41616 | A | | 2/1996 |
| JP | 2002-294425 | A | | 10/2002 |
| JP | 2008190001 | A | * | 8/2008 |
| KR | 2007-0117405 | A | | 12/2007 |

OTHER PUBLICATIONS

Apr. 28, 2025 Office Action issued in Australian Patent Application No. 2022407620.
May 10, 2024 European Search Report issued in European Patent Application No. 22903844.3.
Shin-ichiro Imabayashi; "Effects of surface roughness on wettability of solid surfaces;" Review of Polarography; 2008; pp. 115-121; vol. 54, No. 2.
Jan. 10, 2023 Search Report issued in International Patent Application No. PCT/JP2022/037767.
Dec. 2, 2025 Office Action issued in Korean Patent Application No. 10-2024-7018748 (Search Report in English).
Jul. 4, 2026 Office Action issued in Chinese Patent Application No. 202280079007.X. (English language concise explanation of relevance attached).

* cited by examiner

GAS WIPING NOZZLE AND METHODS FOR MANUFACTURING HOT-DIP METAL-COATED STEEL STRIP AND GAS WIPING NOZZLE

TECHNICAL FIELD

This application relates to a gas wiping nozzle used in a hot-dip metal coating line for manufacturing a hot-dip metal-coated steel strip widely used in the fields of building materials, automobiles, and home appliances, or other fields, and to methods for manufacturing the hot-dip metal-coated steel strip and the gas wiping nozzle.

BACKGROUND

Hot-dip galvanized steel sheets, a type of hot-dip metal-coated steel strips, have been widely used in the fields of building materials, automobiles, and home appliances, or other fields. In these applications, good appearance is required for hot-dip galvanized steel sheets. Since the appearance after painting is strongly affected by surface defects, such as coating thickness unevenness, blemishes, and adhesion of foreign matter, it is important that hot-dip galvanized steel sheets have no surface defects.

In a continuous hot-dip metal coating line, as illustrated in FIG. 1, a steel strip S annealed in a continuous annealing furnace with a reducing atmosphere is continuously introduced into a molten metal bath 14 in a coating tank 12 through a snout 10. The steel strip S then passes through a sink roll 16 and a support roll 18 in a molten metal bath 14 and is pulled up from the molten metal bath 14. The coating on the steel strip S is adjusted to a predetermined thickness by using gas wiping nozzles 20 and 20'. The steel strip S is then cooled and transferred to a subsequent process. The gas wiping nozzles 20 and 20' are disposed above the coating tank 12 so as to face each other with the steel strip S therebetween. A gas is blown to both surfaces of the steel strip S from the ejection ports of the gas wiping nozzles 20 and 20'. This gas wiping scrapes off excess molten metal to adjust the coating weight of the steel strip surface and level the molten metal on the steel strip surface in the sheet width direction and the sheet longitudinal direction. To accommodate various strip widths and accommodate deviations in position of the steel strip in the width direction at the time of pulling up the steel strip, the gas wiping nozzles 20 and 20' are typically wider than the steel strip width and extend beyond the edges of the steel strip in the width direction.

Referring to FIG. 2 as well as FIG. 1, a pair of the gas wiping nozzles 20 and 20' are disposed above the coating tank 12 so as to face each other with the steel strip S therebetween. A gas is blown to the steel strip S from an ejection port 24 (slit) located at an end of each of the gas wiping nozzles 20 and 20' and extending in the sheet width direction X of the steel strip. The gas is blown to one surface of the steel strip from one gas wiping nozzle 20, and the gas is blown to the other surface of the steel strip from the other gas wiping nozzle 20'. This process scrapes off excess molten metal on both surfaces of the steel strip S to adjust the coating weight and make uniform the coating weight in the sheet width direction X and the sheet longitudinal direction Z. To accommodate various strip widths and accommodate deviations in position of the steel strip in the width direction at the time of pulling up the steel strip, the gas wiping nozzles 20 and 20' are typically wider than the steel strip width and extend beyond the edges of the steel strip in the width direction.

Referring to FIG. 3, the wiping nozzle 20 includes a nozzle header 26, an upper nozzle member 21, and a lower nozzle member 22. The upper nozzle member 21 and the lower nozzle member 22 are connected to the nozzle header 26. The upper nozzle member 21 and the lower nozzle member 22 when bonded together vertically define the slit 24 at the end of the wiping nozzle 20 and further define a hollow 25 in communication with the slit 24. In other words, the upper and lower nozzle members 21 and 22 have, at the end portions, flat surfaces facing each other in parallel, and the space between the flat surfaces defines the slit 24. The slit 24 forms a gas ejection port and extends in the sheet width direction X.

In such a gas wiping system, droplets (hereinafter referred to as splashes) of molten metal scattered by wiping gas ejection may adhere to the slit. The adhered splashes block the wiping gas and hinder uniform gas ejection in the sheet width direction. As a result, streaky coating thickness unevenness defects called linear marks are generated at positions on the surface of the steel strip corresponding to the positions of the splashes in the slit, resulting in a significantly reduced yield.

Patent Literature 1 discloses a technique for easily removing splashes by implanting carbon, nitrogen, boron, silicon, or other ions into the surface of a gas ejection end portion of a gas wiping nozzle in the surface treatment to reduce wettability between splashes and the nozzle.

Patent Literature 2 discloses a technique for easily removing splashes similarly to Patent Literature 1 by forming the ejection port of a gas wiping nozzle using a carbon material or a ceramic.

CITATION LIST

Patent Literature

PTL 1: Japanese Examined Patent Application Publication No. 6-17560

PTL 2: Japanese Unexamined Patent Application Publication No. 2008-190001

Non Patent Literature

NPL 1: Review of Polarography, Vol. 54, No. 2, (2008)

SUMMARY

Technical Problem

It is, however, found that the methods disclosed in Patent Literature 1 and Patent Literature 2 cannot completely remove splashes, and some of splashes remain. When splashes remain, splashes are further deposited and grow from those splashes, and more noticeable linear marks are thus generated as the operation time increases. To remove adhered splashes through maintenance, it takes a lot of time and effort to remove, and scratches eventually occur on the nozzle surface.

In light of the above circumstances, the disclosed embodiments are directed to a gas wiping nozzle that can easily remove molten metal splashes and further provide a beautiful steel sheet with no linear mark defects, and methods for manufacturing a hot-dip metal-coated steel strip and a gas wiping nozzle.

Solution to Problem

To solve the above problem, a material having low wettability to molten metals is used in a gas wiping nozzle of the disclosed embodiments. The material having low wettability to molten metals refers to a ceramic.

It is, however, difficult to completely remove splashes only by using the above measure. The inventors of the disclosed embodiments have conceived the idea of controlling the roughness of the nozzle surface by using Formula (1) described below in detail as a method for reducing wettability to molten metals.

$$PPI > c1 \times Ra + c2 \quad (1)$$

PPI: peak count (the number of peaks per inch)
Ra: arithmetic mean roughness [μm]
c1 and c2: constant The gist of the disclosed embodiments accomplished on the basis of the above finding is as described below.

[1] A gas wiping nozzle from which a gas is blown to a steel strip pulled up from a molten metal bath to adjust a coating weight of a molten metal on a surface of the steel strip, wherein at least a surface of a gas wiping nozzle is made of a ceramic, and an arithmetic mean roughness Ra and a peak count PPI, which are measures of surface roughness, of the gas wiping nozzle satisfy Formula (1)

$$PPI > c1 \times Ra + c2 \quad (1)$$

PPI: peak count (number of peaks per inch)
Ra: arithmetic mean roughness [μm]
c1 and c2: constant.

[2] The gas wiping nozzle according to [1], wherein a material of the gas wiping nozzle is a ceramic.

[3] A method for manufacturing a hot-dip metal-coated steel strip, the method including: continuously dipping a steel strip in a molten metal bath; and adjusting a coating weight of a molten metal on both sides of the steel strip by blowing a gas to the steel strip from the gas wiping nozzles according to [1] or [2] disposed to face each other with the steel strip, which is pulled up from the molten metal bath, therebetween to continuously manufacture the hot-dip metal-coated steel strip.

[4] A method for manufacturing the gas wiping nozzle according to [1] or [2], the method including: a step of selecting a material of the gas wiping nozzle or a surface of the gas wiping nozzle; and a step of selecting a processing method and processing conditions for the surface of the gas wiping nozzle, wherein the material and/or the processing method and the processing conditions are selected such that the arithmetic mean roughness Ra and the peak count PPI, which are measures of surface roughness, of the gas wiping nozzle satisfy Formula (1)

$$PPI > c1 \times Ra + c2 \quad (1)$$

PPI: peak count (number of peaks per inch)
Ra: arithmetic mean roughness [μm]
c1 and c2: constant

Advantageous Effects

The disclosed embodiments are directed to a gas wiping nozzle that can easily remove molten splashes of molten metal and enables manufacture of beautiful steel sheets with no linear mark defects. This gas wiping nozzle significantly increases the yield in the manufacture of hot-dip metal-coated steel strips and thus has very high industrial application value.

DETAILED DESCRIPTION

Embodiments of this disclosure will be described below with reference to the drawings. The disclosure is not limited to embodiments described below. The components in the following embodiments include components that can easily be replaced by those skilled in the art, or substantially the same components.

Figure 1:
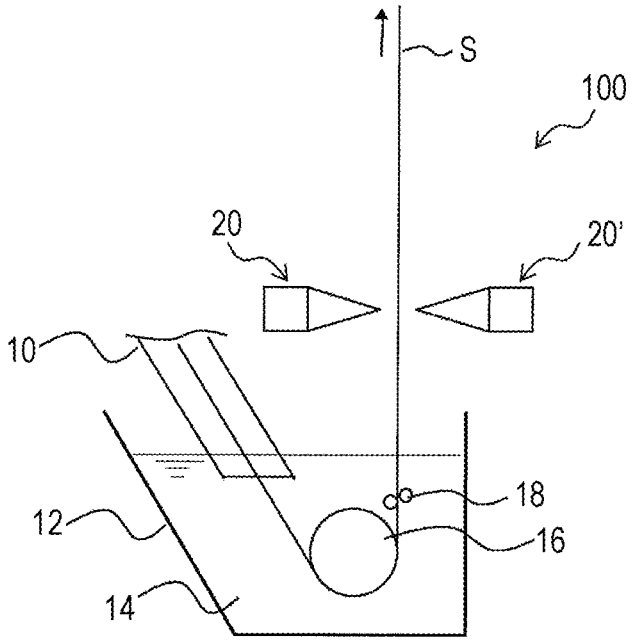
FIG. 1 is a schematic view of the structure of a continuous hot-dip metal coating facility used in an embodiment of the disclosed embodiments.

FIG. 1 is a schematic view of the structure of a continuous hot-dip galvanization facility 100 used in an embodiment of the disclosure. The continuous hot-dip galvanization facility 100 of the disclosed embodiments may be a continuous hot-dip galvanization facility known in the related art.

Figure 2:
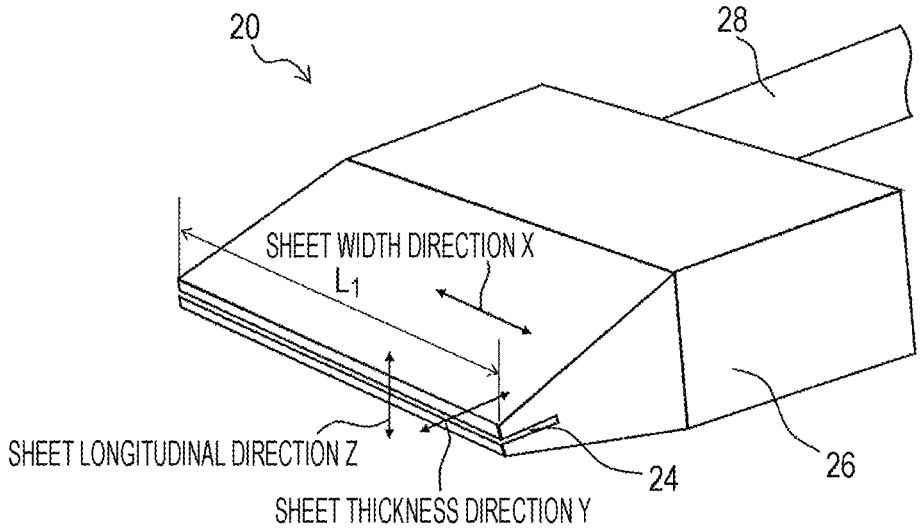
FIG. 2 is a schematic perspective view of a gas wiping nozzle of the disclosed embodiments.

FIG. 2 is a schematic perspective view of a gas wiping nozzle 20 of the disclosed embodiments. A gas wiping nozzle 20' is not described below, but has the same structure as the gas wiping nozzle 20. The gas wiping nozzle 20 blows a gas to a steel strip S pulled up from a molten metal bath to adjust the coating weight of a molten metal on the surface of the steel strip. The components of the gas wiping nozzle 20 and the method for assembling the components may be the same as those in the related art.

The disclosed embodiments are characterized in the material and surface roughness of a nozzle surface portion 23 of the gas wiping nozzle 20 to be in contact with the molten metal (splashes). In other words, at least the surface (i.e., nozzle surface portion 23) of the gas wiping nozzle 20 needs to be made of a ceramic. The nozzle surface portion 23 refers to a region indicated by a dashed line 23 in FIG. 3. In other words, the nozzle surface portion 23 refers to a region in the outer surfaces of the upper and lower nozzle members 21 and 22 from the two-dot dashed line A-A' to an end of the gas wiping nozzle 20, wherein the region does not include the outer surfaces that face the hollow 25 of the nozzle. The entire gas wiping nozzle 20 including the surface is preferably made of a ceramic.

Figure 4:
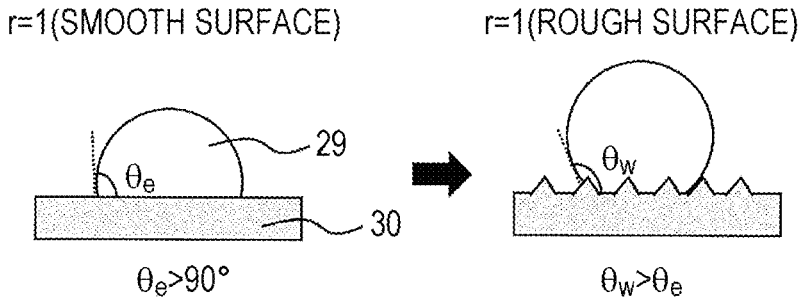
FIG. 4 is a schematic view showing the relationship between surface roughness and wettability based on the Wenzel equation.

The reason why at least the surface of the gas wiping nozzle 20 is made of a ceramic is as follows: ceramics do not react with the molten metal, and the molten metal does not adhere to the surface, so that splashes can be easily removed. In addition, increasing the surface roughness of the ceramic as illustrated in FIG. 4 reduces the wettability between the molten metal and the gas wiping nozzle 20 and allows easier removal of splashes of the molten metal, resulting in an advantage of reduced coating thickness unevenness defects.

Figure 3:
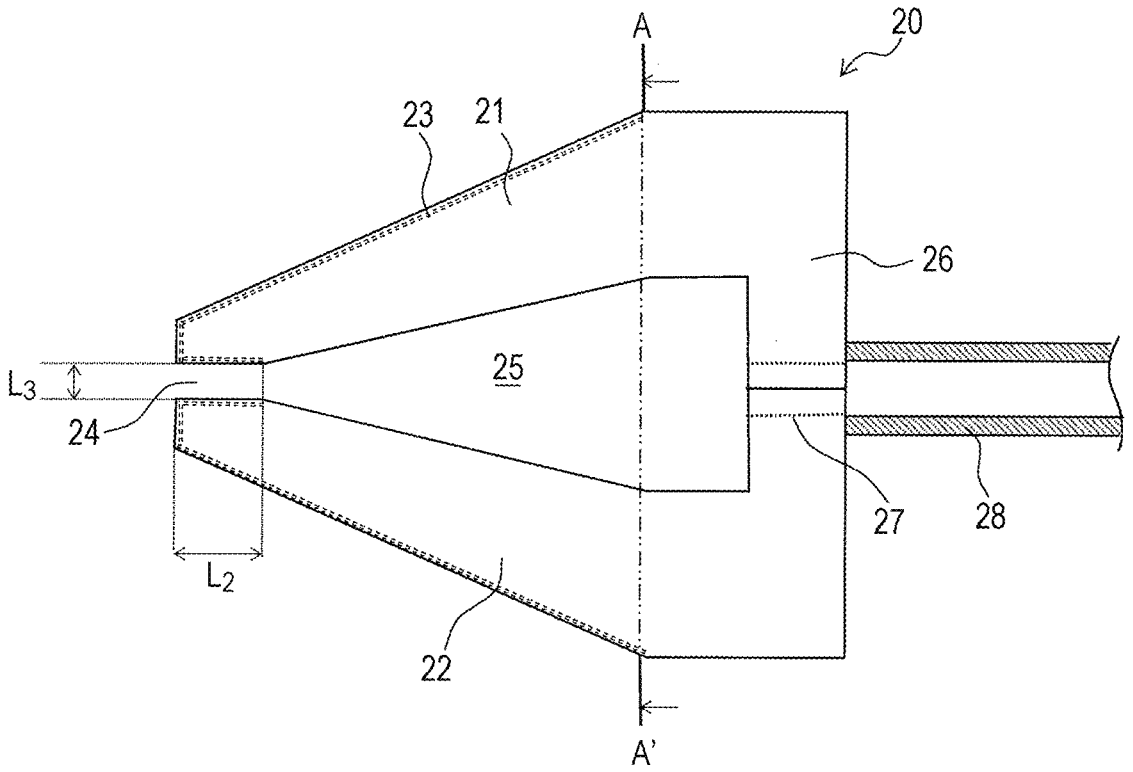
FIG. 3 is a schematic cross-sectional view of the gas wiping nozzle of the disclosed embodiments perpendicular to a steel strip and a bath surface.

Examples of the ceramic include oxide ceramics, such as alumina, zirconia, magnesium oxide, and chromium oxide; and carbide ceramics, such as silicon carbide, titanium carbide, and chromium carbide. In addition, nitride ceramics, such as silicon nitride, titanium nitride, SiAlON, boron nitride, and boride ceramics, such as zirconium boride, and titanium boride, are preferred, but the ceramic is not limited to these ceramics. It is noted that the exemplified carbide ceramics, nitride ceramics, and boride ceramics may be collectively referred to as non-oxide ceramics. Since the adhesion of splashes is found at the nozzle surface portion 23, and many splashes are found particularly near the ejection port of the gas wiping nozzle, the upper nozzle member 21 and the lower nozzle member 22 illustrated in FIG. 3 are also preferably made of a ceramic, which has low wettability to the molten metal.

A method for forming a ceramic coating when forming the nozzle surface portion 23 from a ceramic film is as described below. Suitable examples of the method include, but are not limited to, vapor-phase CVD (low pressure, plasma), PVD (vacuum deposition, ion plating), thermal spraying of molten materials, or application of solutions, and slurry coating with firing. To prevent peeling caused by nozzle cleaning, the coating thickness is preferably about 5 to 100 μm, depending on the type of coating film or the method for forming the coating film.

In addition to using such materials, the arithmetic mean roughness Ra and the peak count PPI, which are measures of surface roughness, of the gas wiping nozzle, need to satisfy Formula (1).

$$PPI > c1 \times Ra + c2 \quad (1)$$

PPI: peak count (the number of peaks per inch)

Ra: arithmetic mean roughness [μm]

c1 and c2: constant

When the arithmetic mean roughness Ra and the peak count PPI do not satisfy Formula (1), splashes cannot be completely removed from the gas wiping nozzle, and linear mark defects occur on the hot-dip galvanized steel sheet. To satisfy Formula (1), it is necessary to control the arithmetic mean roughness Ra and the peak count PPI of the gas wiping nozzle surface to be in contact with splashes.

The surface roughness and the PPI of the surface (i.e., nozzle surface portion 23) of the gas wiping nozzle 20 are controlled.

Formula (1) will be described. The concept of wetting is known from the Wenzel equation.

Formula (2) is the Wenzel equation expressing the relationship between surface roughness and solid surface wettability. Formula (2) is described in Non Patent Literature 1.

$$\cos \theta w = r \cos \theta e \quad (2)$$

θw: the apparent contact angle on a rough surface

θe: the contact angle of a liquid droplet resting on a smooth surface r: the area ratio of the rough surface to the smooth surface (r≥1)

FIG. 4 is a schematic view of wetting properties based on Formula (2). FIG. 4 indicates that, as the surface roughness increases, the contact angle further increases, in other words, the wettability decreases.

The inventors of the disclosed embodiments evaluated the wettability by using the arithmetic mean roughness Ra and the peak count PPI, which are measures of surface roughness, instead of r in Formula (2). Specifically, the relationship between wettability and Ra and peak count PPI was investigated on the basis of experimental values obtained from prepared samples having different Ra and PPI. The experimental procedure and conditions are described below.

Experimental Procedure

Test specimens having different surface roughness were dipped in a molten metal bath for a predetermined time and then naturally cooled to room temperature. A value obtained by dividing a difference in test specimen weight before and after the experiment by the dipped area was recorded as a zinc coating weight [μg/m$^2$] and evaluated on the basis of the following criteria.

A: failed: zinc coating weight ≥5.0 μg/m$^2$

B: passed: zinc coating weight <5.0 μg/m$^2$

Experimental Conditions

Material of test specimens: SiAlON

Size of test specimens: 50 mm long×50 mm wide×3 mm thick

Arithmetic mean roughness Ra of test specimen surface: 0.01 to 5 μm

Peak count PPI of test specimen surface: 5 to 300

Type and temperature of molten metal: zinc, 460° C.

Test time: 30 seconds

Figure 5:
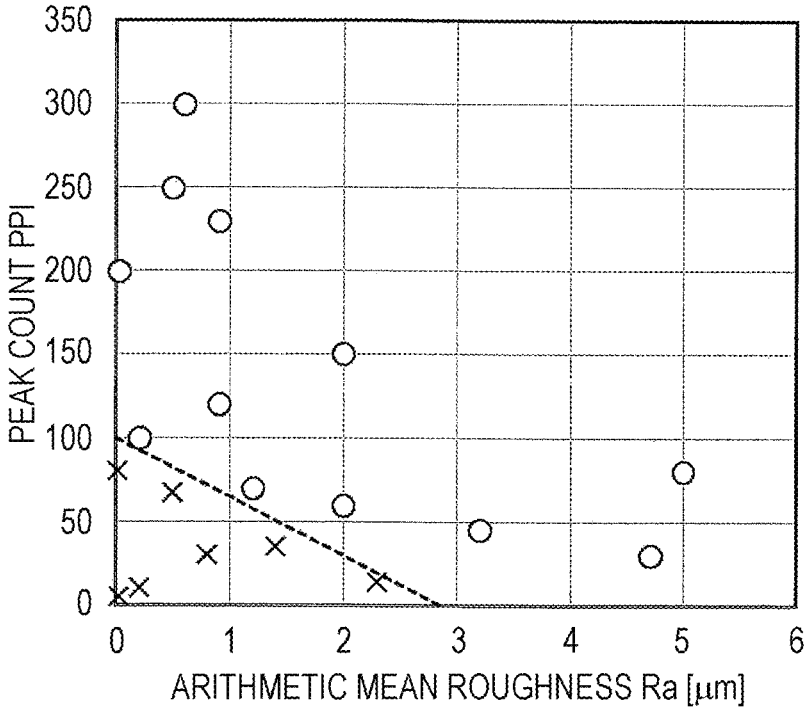
FIG. 5 is a graph showing determination of the zinc coating weight in the relationship between arithmetic mean roughness Ra and peak count PPI.

The experimental results are shown in FIG. 5. The arithmetic mean roughness Ra was measured in accordance with JIS B 0601-2001. The cutoff wavelength in Ra measurement was 0.8 mm. The peak count PPI was measured in accordance with SAE J911. The peak count level in PPI measurement was 0.635 μm. FIG. 5 shows that the zinc coating weight decreases as the Ra and the PPI increase. The arithmetic mean roughness Ra is a measure of the roughness mean height obtained from the roughness curve of the ceramic surface. As the arithmetic mean roughness Ra increases, the roughness amplitude of the ceramic surface increases, and the area ratio of the rough surface to the smooth surface increases. The peak count PPI is a measure of the number of peaks per inch in the roughness curve of the ceramic surface. As the peak count PPI increases, the pitch of roughness on the ceramic surface decreases, and the area ratio of the rough surface to the smooth surface increases. Therefore, as a result of the increase in the area ratio of the rough surface to the smooth surface with increasing Ra and PPI, the contact angle increases in accordance with the Wenzel equation, and the zinc coating weight decreases. In other words, the surface may have low wettability. Zinc is used in this experiment, but other metals, such as Al and Cu, can also be used.

The results in FIG. 5 indicate that the arithmetic mean roughness Ra and the peak count PPI of the surface of the gas wiping nozzle satisfy Formula (1).

$$PPI > c1 \times Ra + c2 \quad (1)$$

PPI: peak count (the number of peaks per inch)

Ra: arithmetic mean roughness [μm]

c1 and c2: constant

Since the constants c1 and c2 in Formula (1) vary with the ceramic material used in the nozzle surface portion 23, the constants c1 and c2 need to be determined as needed in the manufacture of the gas wiping nozzle. The constants c1 and c2 are calculated in accordance with the following steps.

Step 1: Select the material of the nozzle and the component of the molten metal. Since these conditions affect the values of c1 and c2, the constants c1 and c2 are measured whenever the conditions change. The processing method for providing the arithmetic mean roughness Ra and the peak count PPI can be freely selected. Examples of the processing method include, but are not limited to, grinding (a machining method with a grinder) and blasting (a processing method for providing roughness by collision of objects called media to work).

Step 2: Prepare 10 to 20 types of samples having different Ra and PPI. From the viewpoint of wiping nozzle processing accuracy, the upper limit of Ra is preferably 10 μm or less, and the upper limit of PPI is preferably 500 or less.

Step 3: Conduct the experiment described above and plot the graph shown in FIG. 5.

Step 4: Determine temporary c1' and c2' and draw a line $y=c1'x+c2'$ on the graph.

Step 5: Calculate the sum (Y) of squares of differences between PPI in the experimental results and y in the graph in Step 4. ($Y=\Sigma(PPI-y)^2$)

Step 6: Calculate Y by changing the values of c1' and c2' five times, and use c1' and c2' at the smallest Y as c1 and c2. It is noted that each constant is calculated by multiple regression.

The constants c1 and c2 in Formula (1) are mainly correlated with the free energy of formation when the ceramic used in the nozzle surface portion 23 generates an oxide, and determined for each ceramic used in the nozzle surface portion 23.

The arithmetic mean roughness Ra and the peak count PPI formed on the nozzle surface portion 23 have different characteristics depending on the processing method. It is thus necessary to appropriately control the processing conditions depending on the method for processing the gas wiping nozzle in order to satisfy Formula (1). For example, machining or blasting changes Ra and PPI as described below, and it is thus necessary to appropriately select Ra and PPI in the manufacture of the gas wiping nozzle.

Machining:

As the machining speed increases, the PPI increases with Ra constant.

As the radius of the edge of the machining blade increases, the Ra decreases.

As the Ra of the machining blade decreases, the PPI increases.

Blasting:

As the particle size of the media decreases, the Ra and the PPI decrease.

As the media are made of a softer material, the Ra and the PPI decrease.

The gas wiping nozzles having such a configuration are disposed to face each other in the continuous hot-dip metal coating facility 100 in FIG. 1. From the gas wiping nozzles, a gas is blown to the steel strip pulled up from the molten metal bath to adjust the coating weight of the molten metal on both sides of the steel strip, whereby the hot-dip metal-coated steel strip can be manufactured continuously.

Examples

A hot-dip galvanized steel strip was manufactured by dipping a steel strip with a sheet thickness of 1.0 mm and a sheet width of 1200 mm in a molten zinc bath at a threading speed of 2.0 m/s in a continuous hot-dip galvanization facility having the basic structure in FIG. 1. The slit of each gas wiping nozzle has a size of 1800 mm in length L1, 20 mm in depth L2, and 1.2 mm in width L3. The temperature of the molten zinc bath was 460° C., and the gas temperature T at the ends of the gas wiping nozzles was 80° C.

The materials of the gas wiping nozzles were SiAlON, alumina, chrome molybdenum steel with an 80-μm SiAlON coating, and chrome molybdenum steel, which was used as a material having the contact angle of less than 90 degrees. The surface processing was blasting. The processing conditions in blasting were as follows: silicon carbide or alumina was used as media, and the particle size of the media was defined in JIS R6001. The arithmetic mean roughness Ra and the peak count PPI were adjusted by adjusting the projection speed of the media. The constants in Formula (1) were determined in an offline pre-test and found to be c1=−35 and c2=100 for SiAlON. The constants for alumina were found to be c1=−28 and c2=170. The constants for chrome molybdenum steel with an 80-μm SiAlON coating were found to be c1=−35 and c2=100, which were the same as for SiAlON.

The linear mark occurrence rate was evaluated in Examples and Comparative Examples. The linear mark occurrence rate [%] is the ratio of the length of the steel strip determined to have linear mark defects in the inspection process to the length of the steel strip that has passed through under each manufacturing condition. The presence of linear mark defects was visually checked, and steel strips that showed a linear mark occurrence rate of 0.5% or less were determined to be passed. After manufacturing completion, the gas wiping nozzle was disassembled and visually inspected for the presence of surface blemishes (nozzle blemishes) on the gas wiping nozzle. The results are shown in Table 1. The "suitable PPI range derived from Ra value" refers to a range of peak count PPI that satisfies the relationship of Formula (1) for each arithmetic mean roughness Ra.

TABLE 1

| | | Blasting | | | | | | Suitable PPI | | |
|---|---|---|---|---|---|---|---|---|---|---|
| Category | Material of Nozzle Surface Portion | media material | media particle size | Ra [μm] | PPI | c1 | c2 | Range Derived from Ra Value | Linear Mark Occurrence Rate [%] | Nozzle Blemishes |
| Example 1 | SiAlON | silicon carbide | F600 | 0.25 | 100 | −35 | 100 | over 91 | 0.25 | absent |

TABLE 1-continued

| Category | Material of Nozzle Surface Portion | Blasting media material | Blasting media particle size | Ra [μm] | PPI | c1 | c2 | Suitable PPI Range Derived from Ra Value | Linear Mark Occurrence Rate [%] | Nozzle Blemishes |
|---|---|---|---|---|---|---|---|---|---|---|
| Example 2 | SiAlON | silicon carbide | F320 | 0.4 | 180 | −35 | 100 | over 86 | 0.18 | absent |
| Example 3 | SiAlON | silicon carbide | F240 | 0.95 | 240 | −35 | 100 | over 67 | 0.19 | absent |
| Example 4 | SiAlON | silicon carbide | F180 | 5 | 90 | −35 | 100 | over 81 | 0.23 | absent |
| Example 5 | chrome molybdenum steel + SiAlON coating (80 μm) | silicon carbide | F400 | 0.37 | 200 | −35 | 100 | over 87 | 0.28 | absent |
| Example 6 | alumina | alumina | F800 | 0.21 | 210 | −28 | 170 | over 164 | 0.27 | absent |
| Example 7 | alumina | alumina | F280 | 0.37 | 195 | −28 | 170 | over 160 | 0.21 | absent |
| Example 8 | alumina | alumina | F230 | 0.9 | 160 | −28 | 170 | over 145 | 0.19 | absent |
| Example 9 | alumina | alumina | F120 | 4.7 | 70 | −28 | 170 | over 38 | 0.16 | absent |
| Comparative Example 1 | chrome molybdenum steel | silicon carbide | F180 | 0.4 | 180 | — | — | — | 2.67 | present |
| Comparative Example 2 | SiAlON | silicon carbide | F1000 | 0.02 | 5 | −35 | 100 | over 99 | 1.82 | absent |
| Comparative Example 3 | alumina | alumina | F1200 | 0.05 | 120 | −28 | 170 | over 169 | 1.93 | absent |

Table 1 shows that the linear mark occurrence rates in Examples 1 to 9 were much lower than those in Comparative Examples 1 to 3. No surface blemishes were found on the gas wiping nozzles under the conditions of Examples 1 to 9, whereas blemishes were found in Comparative Example 1. This may be because many linear mark defects occur and the number of gas wiping nozzle cleaning increases.

INDUSTRIAL APPLICABILITY

According to the gas wiping nozzle and the method for manufacturing a hot-dip metal-coated steel strip in the disclosed embodiments, it is possible to easily remove molten metal splashes on the gas wiping nozzle and further provide a beautiful steel sheet with no linear mark defects. The disclosed embodiments allow manufacture of a hot-dip metal-coated steel strip at high yield and thus has very high industrial application value.

The invention claimed is:

1. A gas wiping nozzle that is configured to blow gas to a steel strip pulled up from a molten metal bath to adjust a coating weight of a molten metal on a surface of the steel strip, wherein:

at least a surface of the gas wiping nozzle is made of a ceramic, and an arithmetic mean roughness Ra and a peak count PPI, which are measures of surface roughness, of the gas wiping nozzle satisfy Formula (1)

$$PPI > c1 \times Ra + c2 \quad (1)$$

PPI: peak count (number of peaks per inch)

Ra: arithmetic mean roughness [μm]

c1 and c2: determined constants for each ceramic used in a surface of the gas wiping nozzle, a surface roughness of the gas wiping nozzle satisfies Formula (2)

$$\cos\theta_w = r * \cos\theta_e \quad (2)$$

$\theta_w$: apparent contact angle on a rough surface $\theta_e$: contact angle of a liquid droplet on a smooth surface r: area ratio of the rough surface to the smooth surface (r≥1). the ceramic is SiAlON or alumina. when the ceramic is SiAlON, c1 is-35 and c2 is 100, and when the ceramic is alumina, c1 is-28 and c2 is 170.

2. The gas wiping nozzle according to claim 1, wherein the entire gas wiping nozzle is made of a ceramic.

3. A method for manufacturing a hot-dip metal-coated steel strip, the method comprising:

continuously dipping a steel strip in a bath of molten metal; and adjusting a coating weight of the molten metal on both sides of the steel strip by blowing a gas to the steel strip from a plurality of the gas wiping nozzle according to claim 1 that are disposed to face each other with the steel strip, which is pulled up from the bath, therebetween to continuously manufacture the hot-dip metal-coated steel strip.

4. A method for manufacturing the gas wiping nozzle according to claim 1, the method comprising:

selecting a material of the gas wiping nozzle or of a surface of the gas wiping nozzle; and selecting a processing method and processing conditions for the surface of the gas wiping nozzle; and manufacturing the gas wiping nozzle according to the selected processing method and processing conditions, wherein the material and/or the processing method and the processing conditions are selected such that the arithmetic mean roughness Ra and the peak count PPI, which are measures of surface roughness, of the gas wiping nozzle satisfy Formula (1)

$$PPI > c1 \times Ra + c2 \quad (1)$$

PPI: peak count (number of peaks per inch)

Ra: arithmetic mean roughness [μm]

c1 and c2: determined constants for each ceramic used in the surface of the gas wiping nozzle.

5. A method for manufacturing a hot-dip metal-coated steel strip, the method comprising:

continuously dipping a steel strip in a bath of molten metal; and adjusting a coating weight of the molten metal on both sides of the steel strip by blowing a gas to the steel strip from a plurality of the gas wiping nozzle according to claim 2 that are disposed to face each other with the steel strip, which is pulled up from the bath, therebetween to continuously manufacture the hot-dip metal-coated steel strip.

6. A method for manufacturing the gas wiping nozzle according to claim 2, the method comprising:

selecting a material of the gas wiping nozzle or of a surface of the gas wiping nozzle;

selecting a processing method and processing conditions for the surface of the gas wiping nozzle; and manufacturing the gas wiping nozzle according to the selected processing method and processing conditions, wherein the material and/or the processing method and the processing conditions are selected such that the arithmetic mean roughness Ra and the peak count PPI, which are measures of surface roughness, of the gas wiping nozzle satisfy Formula (1)

$$PPI > c1 \times Ra + c2 \quad (1)$$

PPI: peak count (number of peaks per inch)

Ra: arithmetic mean roughness [μm]

c1 and c2: determined constants for each ceramic used in the surface of the gas wiping nozzle.

* * * * *